United States Patent [19]

Suzuki et al.

[11] Patent Number: 4,688,156

[45] Date of Patent: Aug. 18, 1987

[54] LIGHT-SHIELDING SCREEN DEVICE

[75] Inventors: Akira Suzuki, Nagoya; Yukio Mizuta, Nishi Kasugai; Rêjirō Satō, Fuji; Kunio Shimizu, Ootsuki, all of Japan

[73] Assignee: Kabushiki Kaisha Tokai, Aichi, Japan

[21] Appl. No.: 727,139

[22] Filed: Apr. 25, 1985

[30] Foreign Application Priority Data

Apr. 26, 1984 [JP] Japan ..... 59-63140[U]

[51] Int. Cl.[4] ..... F21V 11/00

[52] U.S. Cl. ..... 362/354; 362/29

[58] Field of Search ..... 362/255, 256, 457, 351, 362/353, 354, 359, 29, 30

[56] References Cited

U.S. PATENT DOCUMENTS

| | | | |
|---|---|---|---|
| 1,804,719 | 5/1931 | Timmons | 362/354 |
| 2,010,004 | 8/1935 | Berggren | 362/255 |
| 2,540,271 | 2/1951 | Lytton | 362/351 |
| 2,931,117 | 4/1960 | Bosworth et al. | 362/351 |
| 3,076,178 | 1/1963 | Hastings | 362/351 |
| 3,288,990 | 11/1966 | Stahlhut | 362/330 |
| 3,940,896 | 3/1976 | Steel | 362/354 |
| 4,152,618 | 5/1979 | Abe et al. | 362/355 |
| 4,530,041 | 7/1985 | Yamai et al. | 362/351 |

FOREIGN PATENT DOCUMENTS

| | | | |
|---|---|---|---|
| 507124 | 9/1930 | Fed. Rep. of Germany | 362/351 |
| 57-89701 | 6/1982 | Japan . | |
| 57-165802 | 10/1982 | Japan . | |
| 265455 | 2/1927 | United Kingdom | 362/351 |
| 713737 | 8/1954 | United Kingdom | 362/354 |

*Primary Examiner*—Margaret A. Focarino
*Assistant Examiner*—H. A. Odar
*Attorney, Agent, or Firm*—Birch, Stewart, Kolasch and Birch

[57] ABSTRACT

A light-shielding screen device comprising a first light transmissible substrate, a second light transmissible substrate and an intermediate layer sandwiched therebetween, the intermediate layer comprising at least one light-shielding screen portion located in the middle area of the intermediate layer and a light non-transmissible retaining portion located at least in a portion of the remaining area of the intermediate layer, the portion of the remaining area including the entire outermost peripheral area of the intermediate layer. The light non-transmissible retaining portion of the intermediate layer of the present light-shielding screen device securely retains on its both sides the first and second light transmissible substrates, respectively. The present light-shielding screen device can be advantageously used not only as a light-shielding screen for television receivers, various displays having a CRT related to computers and the like in which a high mechanical strength of the light-shielding screen device is not necessarily required but also as an indicator means for push button type switches mounted on, e.g., an instrument panel of an automobile in which switches the light-shielding screen device is required to have a high mechanical strength.

18 Claims, 6 Drawing Figures

LIGHT-SHIELDING SCREEN DEVICE

The present invention relates to a light-shielding screen device. More particularly, the present invention is concerned with a light-shielding screen device comprising a first light transmissible substrate, a second light transmissible substrate and an intermediate layer sandwiched therebetween. The intermediate layer comprises at least one light-shielding screen portion located in the middle area of the intermediate layer and a light non-transmissible retaining portion located at least in a portion of the remaining area of the intermediate layer, the portion of the remaining area including the entire outermost peripheral area of the intermediate layer, thereby causing the intermediate layer comprising at least one light-shielding screen portion to be securely held between the first light transmissible substrate and the second light transmissible substrate.

As is well known, a light-shielding screen has been used for extraneous light rays-shielding applications in various image-indicating devices such as television receivers, various computer-related displays having a CRT (cathode-ray tube), various indicators such as indicators for instruments, traffic signals and the like. Recently, in various indicators mounted on an instrument panel of an automobile and adapted to emit signals by means of a light from a lamp, a light-shielding screen having an image such as letter or mark printed thereon has been increasingly used for shielding extraneous light rays incident on the signal devices, and for shielding the light emitted in the unnecessary directions from the lamp, thereby to regulate the visible angle range of the image illuminated by the lamp.

For example, Japanese Patent Application Laid-Open Specification Nos. 57-89701/1982 and 57-165802/1982 disclose a light-shielding screen comprising a transparent plate and a plurality of relief lines of a photocured resin composition provided on the entire surface of one side of the transparent plate, the relief lines being arranged to form a striped pattern structure or a lattice pattern structure. The light-shielding screen disclosed in the above-mentioned Japanese Patent Application Laid-Open Specifications may be used for television receivers, various computer-related displays having a CRT and the like. However, it is noted that with respect to indicators of push button type switches which have been increasingly incorporated in an automobiles, the above-mentioned conventional light-shielding screen cannot be advantageously used. The reason for this is as follows. When the above-mentioned light-shielding screen is used in a push button type signal indicator, another transparent plate is securely attached to the relief on the transparent plate. In other words, the relief lines are sandwiched as an intermediate layer between the two transparent plates. If desired, a plurality of predetermined images are then printed on one of the transparent substrates. Subsequently, the resulting product is cut into a plurality of sections each having an image thereon,if any. The section serving as an indicator is securely attached to a knob of a push button type switch which is adapted to actuate a lamp to illuminate the indicator means in synchronization with the on-operation of the switch. As mentioned above, in the conventional light-shielding screen, the relief lines are formed as an intermediate layer on the entire surface of the transparent plate. Therefore, the area of bonding between the intermediate layer and the transparent plates is small. Because of the small bond area, the bonding strength between the intermediate layer and the transparent plates is poor. For this reason, in preparing an indicator means by cutting the light-shielding screen into a plurality of sections, the transparent plates inevitably tend to peel off from the intermediate layer of relief lines sandwiched between the two transparent plates. Even though in cutting the light-shielding screen into a plurality of sections, the transparent plates do not peel off from the intermediate layer, the section obtained cannot be advantageously used as an indicator means for push button type switches. Specifically, since in a push button type switch as constructed in the above-mentioned manner, the indicator means is repeatedly pushed for switching an instrument on or off connected to the switch, the indicator means should have a high mechanical strength. As mentioned above, the indicator means made of the conventional light-shielding screen is extremely poor in bond strength between the transparent plates and the intermediate layer and, hence, the transparent plates unfavorably tend to peel off from the intermediate layer in a short period of time. As is apparent from the foregoing, the conventional light-shielding screen is poor in bond strength between the transparent plates and the intermediate layer and, hence, the applications therefor were limited to those where a high mechanical strength is not required.

The present inventors have made extensive and intensive studies with a goal toward eliminating the above-mentioned drawbacks of the conventional light-shielding screen and toward providing a light-shielding screen which has a high mechanical strength sufficient for use as an indicator means of push button type switches. As a result, the present inventors have found that a light-shielding screen device comprising a first and a second light transmissible substrate and an intermediate layer provided between the first and second light transmissible substrates and comprising at least one light-shielding screen portion located in the middle area of the intermediate layer and a light non-transmissible retaining portion located at least in a portion of the remaining area of the intermediate layer, which portion of the remaining area includes the entire outermost peripheral area of the intermediate layer, is excellent in bond strength between the first and second light transmissible substrates and the intermediate layer and, hence, can be particularly advantageous for use as an indicator means of push button type switches.

Based on such a novel finding the present invention has been made.

Accordingly, it is an object of the present invention to provide a light-shielding screen device having a high mechanical strength.

It is another object of the present invention to provide a light-shielding screen device, which is simple in structure and can be easily produced at a low cost. The foregoing and other objects, features and advantages of the present invention will be apparent from the following description taken in connection with the accompanying drawings in which:

In FIGS. 1 to 6, like portions or parts are designated by like numerals.

In accordance with the present invention, there is provided a light-shielding screen device comprising:

(a) a first light transmissible substrate;

(b) an intermediate layer provided on the surface of the first light transmissible substrate, the intermediate layer comprising at least one light-shielding screen portion and a light non-transmissible retaining portion, the at least one light-shielding screen portion being located in the middle area of the intermediate layer and the light non-transmissible retaining portion being located at least in a portion of the remaining area of the intermediate layer, the portion of the remaining area including the entire outermost peripheral area of the intermediate layer, the light-shielding screen comprising a plurality of light-shielding lines; and (c) a second light transmissible substrate provided on the surface of the intermediate layer remote from the first light transmissible substrate, the light non-transmissible retaining portion of the intermediate layer securely retaining on its both sides the first light transmissible substrate and the second light transmissible substrate, respectively.

The light-shielding screen device of the present invention comprises a first light transmissible substrate, an intermediate layer provided on the surface of the first transmissible substrate, and a second light transmissible substrate provided on the surface of the intermediate layer remote from the first light transmissible substrate. The intermediate layer is sandwiched between the first light and second transmissible substrates. The intermediate layer comprises at least one light-shielding screen portion and a light non-transmissible retaining portion. The light-shielding screen portion is located in the middle area of the intermediate layer and the light non-transmissible retaining portion is located at least in a portion of the remaining area of the intermediate layer, the portion of the remaining area including the entire outermost peripheral area of the intermediate layer. The light-shielding screen comprises a plurality of light-shielding lines. The light non-transmissible retaining portion of the intermediate layer securely retains on both its sides the first light transmissible substrate and the second light transmissible substrate, respectively.

The term "entire outermost peripheral area of the intermediate layer" is defined as a portion of the intermediate layer which includes the overall edge of the intermediate layer and a region continuously extending from the overall edge toward the middle portion in which at least one light-shielding screen portion is located and having a minimum width sufficient to retain the first and second light transmissible substrates on both sides of the intermediate layer. The above-mentioned minimum width may vary according to the kinds of the materials of intermediate layer and the first and second light transmissible substrates, but may generally be about 1.0 mm or more.

Figure 1:
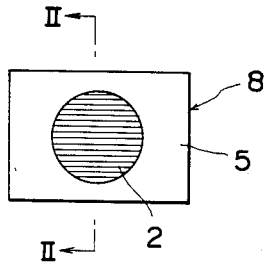
FIG. 1 is a front view of one form of a light-shielding screen device according to the present invention.

Referring now to FIG. 1, there is a front view of one form of a light-shielding screen device according to the present invention, which comprises a first light transmissible substrate (not designated there due to its transparency), an intermediate layer 8 provided on the surface of the first light transmissible substrate and a second light transmissible substrate (behind the drawing) provided on the intermediate layer 8. The intermediate layer 8 comprises a light-shielding screen portion 2 located in the middle of the intermediate layer 8 and a light non-transmissible retaining portion 5 entirely located in the remaining area of the intermediate layer 8.

Figure 2:
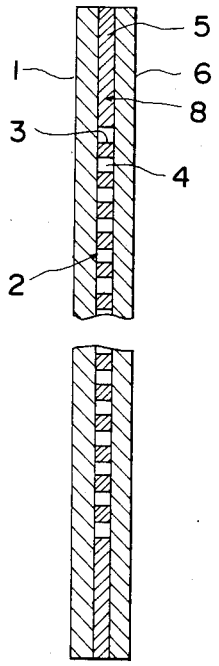
FIG. 2 is an enlarged cross-sectional view taken along the line II—II of FIG. 1.

In FIG. 2 shows an enlarged cross-sectional view taken along the line II—II of FIG. 1, in which numeral 1 designates a first light transmissible substrate, numeral 6 a second light transmissible substrate, numeral 3 light-shielding lines constituting a light-shielding screen in the intermediate layer 8 and numeral 4 spaces between the light-shielding lines 3. In the present invention, it is required that the remaining area of the intermediate layer 8 in which the light non-transmissible retaining portion 5 is located include the entire outermost peripheral area of the intermediate layer 8. In other words, the entire outermost peripheral area of the intermediate layer 8 is securely attached,on one side thereof, to the surface of the first light transmissible substrate 1 and, on the other side thereof, to the surface of the second light transmissible substrate 6. By virtue of the above structure, the light-shielding screen device of the present invention has excellent bond strength between the first and second light transmissible substrates 1, 6 and the intermediate layer 8.

Figure 3:
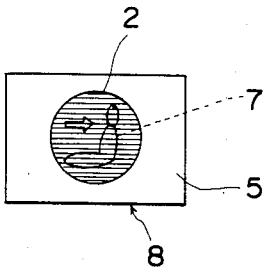
FIG. 3 is a front view of another form of a light-shielding screen device according to the present invention.

FIG. 3 shows a front view of another form of a light-shielding screen device according to the present invention, which comprises a first light transmissible substrate (not designated there due to its transparency), an intermediate layer 8 which is provided on the first light transmissible substrate and which has a light-shielding screen portion 2 located in the middle of the intermediate layer 8 and a light non-transmissible retaining portion 5 entirely located in the remaining area of the intermediate layer 8 and a second light transmissible substrate (behind the drawing) on which an image 7 is printed at the place corresponding to the light-shielding screen portion 2 of the intermediate layer 8.

Figure 4:
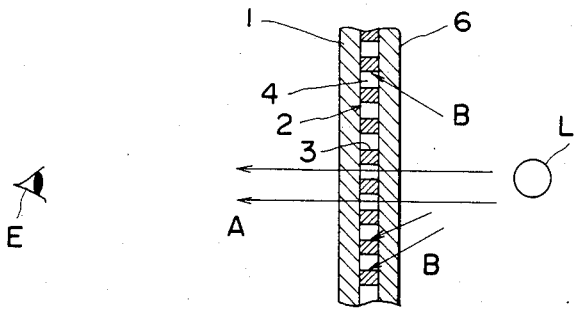
FIG. 4 is a schematic view explaining the optical mechanism according to which the light-shielding screen device of the present invention regulates the visible angle range to attain the light-shielding effect.

FIG. 4 shows a schematic view of the light-shielding effect of the light-shielding screen device of the present invention in which character L designates a lamp L and character E an eye of a man, for example, an automobile driver. The light rays in the direction indicated by an arrow A reach the eye E of the driver through the spaces 4 between the light-shielding lines 3 of the light-shielding screen portion 2. On the other hand, the light rays in the direction indicated by an arrow B are effectively shielded by the light-shielding lines 3 and, hence, do not pass through the light-shielding screen device. This prevents the light rays emitted from the lamp L from diffusing into the inside of the automobile and reflecting on a windshield, a side mirror or a side window of the automobile.

Figure 5:
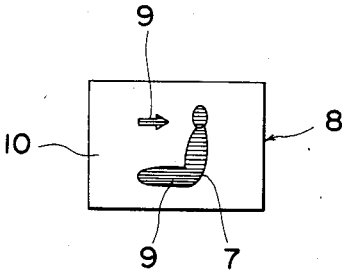
FIG. 5 is a front view of a further form of a light-shielding screen device according to the present invention.

FIG. 5 shows a front view of a further form of a light-shielding screen device according to the present invention, which comprises a first light transmissible substrate (not designated there due to its transparency), an intermediate layer 8 provided on the surface of the first light transmissible substrate and a second light transmissible substrate (behind the drawing) provided on the intermediate layer 8. The intermediate layer 8 comprises two light-shielding screen portions 9 located in the middle of the intermediate layer 8 and a light non-transmissible retaining portion 10 entirely located in the remaining area of the intermediate layer 8. The form of the light-shielding screen device shown in FIG. 5 is characterized in that the light-shielding screen portion 9 of the intermediate layer 8 is formed in the form of predetermined images 9, 9 as opposed to the form of the light-shielding screen device shown in FIG. 3 in which the predetermined images are printed on the light transmissible substrate.

Figure 6:
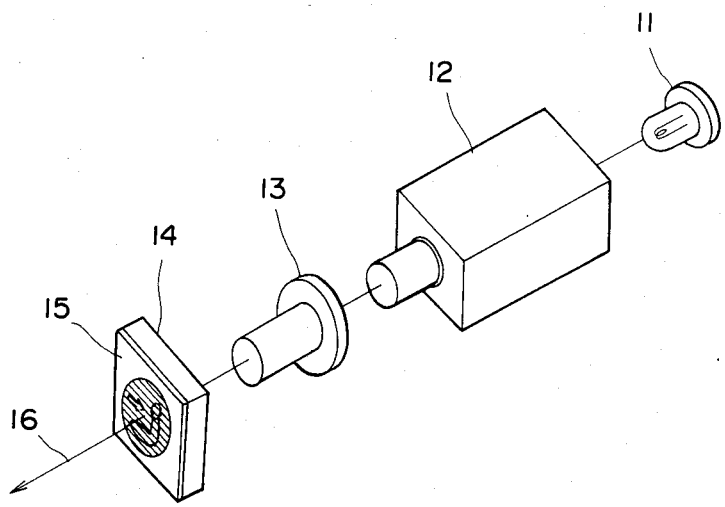
FIG. 6 is a schematic, perspective view of a push button type switch system in which a light-shielding screen device of the present invention is attached to a knob of the switch system.

FIG. 6 shows a schematic perspective view of a push button type switch system mounted on, e.g., the instrument panel of an automobile in which system a light-shielding screen device of the present invention is used as an indicator means. In FIG. 6, numeral 11 designates a lamp, numeral 12 a switch, numeral 13 a light-transmitting tube, numeral 14 a knob and numeral 15 a light-shielding screen of the present invention as shown in FIG. 3. The light-shielding screen device 15 as an indicator means is attached to the knob 14. By pushing the indicator means 15 the lamp 11 is actuated to illuminate the indicator means 15 in synchronization with the on-operation of the switch 12. The light 16 emitted from the lamp 11 reaches the indicator means 15 through the switch 12, the light-transmitting tube 13 and the knob 14, and illuminates the image on the indicator means 15. The light-shielding screen device of the present invention has excellent bond strength between the first and second light transmissible substrates and the intermediate layer, and, hence, there is no danger that the first and second light transmissible substrates peel off from the intermediate layer even by repeated pushing operations.

In the present invention, the first and second light transmissible substrates may be made of any film or sheet transparent to light, and the first light transmissible substrate is the same as or different from the second light transmissible substrate in their materials. As examples of the substrates, there may be mentioned films or sheets of synthetic resins such as acrylate resins, polyester resins, polycarbonate resins and nylon .

As mentioned above, the intermediate layer of the light-shielding screen device of the present invention comprises at least one light-shielding screen portion and a light nontransmissible retaining portion. The light-shielding screen portion is located in the middle area of the intermediate layer and the light non-transmissible retaining portion is located at least in a portion of the remaining area of the intermediate layer, the portion of the remaining area including the entire outermost peripheral area of the intermediate layer.

In the present invention, it is preferred that the light non-transmissible retaining portion be located in an entire portion of the remaining area of the intermediate layer. However, there may exist between the light-shielding screen portion and the outermost peripheral area of the intermediate layer a portion which does not serve to retain the first and second light transmissible substrate, as far as the entire outermost peripheral area of the intermediate layer can securely retain on its both sides the first and second light transmissible substrates, respectively. In this case, it is required that even the portions which do not serve to retain the first and second light transmissible substrates, if any, be also non-transparent to light.

In the present invention, it is preferable that the minimum distance between the edge of the intermediate layer and the circumference of the light-shielding screen portion be 1 mm or more.

With respect to the light-shielding screen portion of the intermediate layer, the light-shielding lines may be arranged to form any pattern structure. For example, as examples of the pattern structure, there may be mentioned striped pattern structures, circular pattern structures and polygonal pattern structures, e.g. triangular, square, rectangular, rhombic, parallelogramic or honeycomb (hexagonal) pattern structure.

In general, the light-shielding lines each have a width of about 10 to 500 micrometers and are arranged at about 20 to 1,000 micrometers. The ratio of the width of the light-shielding line to the interval of the light-shielding lines is generally about 1:1 to 1:20.

In the present invention, the intermediate layer may be one comprising a photocured resin composition, a photosensitive glass such as Fotoform glass (manufactured and sold by Corning Glass, U.S.A.) or the like.

As examples of the photocured resin composition, there may be mentioned those obtained by photocuring a photocurable resin composition. The photocurable resin composition is defined as those which are capable of being insolubilized upon exposure to actinic radiation.

The representative examples of the photocurable resin composition are (1) a radical photopolymerizable composition comprising a compound having a polymerizable ethylenically unsaturated group and a radical photopolymerization initiator; (2) an addition photoreactable composition comprising a polyene compound having a plurality of double bonds, a polythiol compound having a plurality of thiol groups and a photosensitizer; (3) a cation photopolymerizable composition comprising a cation polymerizable compound having an epoxy group or the like and a cation photopolymerization initiator; and (4) a photocrosslinkable composition comprising a polymer having a functional group capable of being photodimerized.

As examples of the compound having a polymerizable ethylenically unsaturated group contained in the above-mentioned composition (1), there may be mentioned unsaturated prepolymers such as unsaturated polyesters, unsaturated polyurethanes, oligomers of an ester-acrylate type, unsaturated polyimides, unsaturated polyethers, unsaturated polyacrylates and unsaturated polymethacrylates; unsaturated monomers such as acrylic acid, acrylic esters, methacrylic acid, methacrylic esters, acrylamide and its derivatives, methacrylamide and its derivatives, allyl compounds, maleic acid and esters thereof, fumaric acid and esters thereof; and other unsaturated compounds such as styrene and its derivatives, N-vinylcarbazole and N-vinylpyrrolidone. They may be used either alone or in combination.

Specific examples of the radical photopolymerization initiator contained in the above-mentioned composition (1) include benzoin, benzoin alkyl ethers, acetophenone, 2,2'-dimethoxy-2-phenylacetophenone, benzophenone, benzil, thioxanthone and anthraquinone.

The above-mentioned composition (1) may optionally contain a binder polymer and a heat polymerization inhibitor. As examples of the binder polymer, there may be mentioned polymers such as polyvinyl alcohols, polyamides, polyvinylpyrrolidones, acrylic resins, cellulose derivatives, polystyrenes, phenol resins and polyesters. As examples of the heat polymerization inhibitor, there may be mentioned hydroquinone, p-methoxyphenol, 2,6-di-tert-butyl-p-cresol and the like.

As examples of the polyene compound contained in the above-mentioned composition (2), there may be mentioned polyurethanes having at their terminals an ally group, an acryloyl group or a methacryloyl group.

As examples of the polythiol compound and photosensitizer contained in the above-mentioned composition (2), there may be mentioned pentaerythritol tetra($\beta$-mercaptopropionate) and benzophenone, respectively.

As examples of the cation polymerizable compound contained in the above-mentioned composition (3), there may be mentioned epoxy resins and polyacrylates having at side chains a glycidyl group.

Specific examples of the cation photopolymerization initiator contained in the above-mentioned composition (3) include compounds which, upon exposure to light rays, produce Lewis acid salts, e.g. organic diazonium salts, organic halonium salts and organic sulfonium salts.

As examples of the polymer having a photodimerizable functional group contained in the above-mentioned composition (4), there may be mentioned polymers having a cinnamoyl group, a styrylpyridinium group or a quinolinium group.

The above-mentioned compositions may optionally contain a delustering agent, a dye and a pigment.

As examples of the delustering agent, there may be mentioned titanium oxide, mica, calcium carbonate, a powdered glass, a finely divided silica, aluminum powder, a powdered clay and the like. The amount of the delustering agent may generally be in the range of 0.1 to 20% by weight, preferably 0.5 to 10% by weight based on the photocurable resin composition.

The specific kind of the dye and pigment will be mentioned later.

A representative example of the method of producing the light-shielding screen device of the present invention will be explained below. A layer of a photo-curable resin composition is interposed between a first light transmissible substrate and a negative film. The negative film has a plurality of portions in which a plurality of lines are arranged to form a negative image of a predetermined pattern of the light-shielding portion, and the remaining area of the negative film, i.e., the area corresponding to the light non-transmissible retaining portion of the intermediate layer is transparent. The photocurable resin composition layer is exposed to actinic radiation to form photocured resin composition portions and uncured resin composition portions. As examples of the actinic light which may be used in this step, there may be mentioned a solar light or a radiation emitted from an arc lamp, a mercury lamp, a xenon lamp, an ultra-violet fluorescent lamp and the like. The negative film is then removed. The uncured portions are removed by means of a developer. For example, the uncured portions may be removed by spraying a developer to wash away the uncured portions; by a brushing method in which the uncured portions are brushed with a developer bearing brush; a blowing method in which air is blown upon the uncured portions; a sucking method; or combined methods of the those mentioned above.

The term "developer" used herein is intended to include a liquid developer and air. As the liquid developer, there may be mentioned, for example, water, an alkaline solution such as aqueous sodium hydroxide solution, aqueous sodium carbonate solution, aqueous sodium borate solution, aqueous sodium silicate solution, aqueous sodium phosphate solution and aqueous sodium aluminate solution, an aqueous solution of a surface active agent, and various organic solvents such as alcohol, 1,1,1-trichloroethane, tetrachloroethylene, trichloroethylene, tetrachloroethane, toluene and mixtures thereof.

Subsequently, the remaining photocured resin composition portions are dyed with a dye to make them non-transparent to light. Alternatively, a dye or pigment may be incorporated into the photocurable resin composition in advance and subjected to exposure and development. In this case, it is necessary to incorporate a dye or pigment into the resin composition in such an amount that the photosensitivity of the photocurable resin composition is not remarkably decreased.

As examples of the dye, there may be mentioned a cationic dye, a disperse dye, an acid dye, a metallized dye, a reactive dye, a direct dye and the like. The kind of dye to be used may be chosen based on the compatibility with the photocurable resin composition and on the absorption characteristics of the dye.

As examples of the pigment, there may be mentioned inorganic and organic pigments. Of them a pigment having good dispersion properties in the photocurable resin composition is preferred.

A second light transmissible substrate is attached to the above-mentioned product on the surface of the remaining photocured portions by an adhesive. As examples of the adhesive, there may be mentioned nitrile rubber type adhesives, polyester type adhesives, epoxy type adhesives, vinyl acetate copolymer type adhesives, synthetic rubber type adhesives, acrylic type adhesives, chloroprene type adhesives, urethane type adhesives and silane compound type adhesives. The kind of adhesive to be used may be chosen according to the materials of the intermediate layer (photocured resin composition) and the second light transmissible substrate. The method of attaching the second light transmissible substrate to the intermediate layer is not critical but the thermocompression bonding method by means of a laminator is generally used.

The above-obtained laminate may be cut to obtain a plurality of light-shielding screen devices. Alternatively, images such as letters or marks are printed on the surface of either the first light transmissible substrate or the second light transmissible substrate at the places corresponding to the light-shielding screen portions. Then the resulting laminate having images thereon is cut to obtain a plurality of light-shielding screen devices having an image on the first or second light transmissible substrate.

In this instance, due to the high bond strength between the first and second light transmissible substrates and the intermediate layer, there is no danger that the light transmissible substrate peels off from the intermediate layer.

As mentioned above, in the light-shielding screen device of the present invention, at least one light-shielding screen portion is located in the middle area of the intermediate layer. The light-shielding screen comprises a plurality of light-shielding lines. The plurality of light-shielding lines may be arranged at spaced intervals. In this case, the plurality of light-shielding lines may be horizontal, vertical or aslant as viewed against the surface of the first light transmissible substrate. When the light-shielding lines are aslant as viewed against the surface of the first light transmissible substrate, it is preferable that the aslanting angle relative to the horizontal direction is 30° to 60°.

Further, the light-shielding screen device may have a screen pattern structure which comprises a first plurality of light-shielding lines arranged at spaced intervals and a second plurality of crossing light-shielding lines arranged at spaced intervals which intersect the first light-shielding lines. In this case, the crossing light-shielding lines may orthogonally intersect the first light-shielding lines as viewed against the surface of said first light transmissible substrate.

Furthermore, the light-shielding lines may be left aslant with a slanting angle of 30° to 60° relative to the horizontal direction as viewed against the surface of the first light transmissible substrate and the crossing light-shielding lines may be right aslant with a slanting angle of 30° to 60° relative to the horizontal direction as viewed against the surface of the first light transmissible substrate.

As described in the foregoing, the light-shielding screen device of the present invention has excellent bond strength between the first and second substrates and the intermediate layer having at least one light-shielding portion and, hence, can be advantageously used not only for television receivers, various computer-related displays having a CRT and the like in which a high mechanical strength of the light-shielding screen device is not necessarily required but also for indicators of push button type switches mounted on, e.g., an instrument panel of an automobile in which a high mechanical strength of the lightshielding device is required.

The present invention will be illustrated in more detail with reference to the following Examples, which should not be construed to be limiting the scope of the present invention. The parts are by weight, unless otherwise indicated. In the Example and the Comparative Example, ADOCOTE manufactured and sold by TOYO MORTON, Japan was used as a urethane type adhesive, and a laminator MODEL AL-70 manufactured and sold by Asahi Kasei Kogyo K.K. was used for bonding the intermediate layer to the second light transmissible substrate.

EXAMPLE 100 parts of an unsaturated polyester resin having an acid value of 30 mg KOH/g prepared by effecting condensation polymerization of a mixture of propylene glycol, diethylene glycol, adipic acid, fumaric acid and isophthalic acid at a molar ratio of 0.12/0.38/0.24/0.14/0.12, 12 parts of diethylene glycol dimethacrylate, 30 parts of tetraethylene glycol dimethacrylate, 12 parts of 2-hydroxyethyl methacrylate, 6 parts of diacetone acrylamide, 2 parts of benzoin isobutyl ether and 0.03 part of 4-tert-butyl catechol were mixed to obtain a photocurable resin composition. To this photocurable resin composition was added 5% by weight of a finely divided silica as a delustering agent to obtain a photocurable resin composition containing a delustering agent.

Separately, on transparent glass was placed a negative film having a negative image of a plurality of the circular light-shielding screen portions 2 having a striped pattern as depicted in FIG. 1 (diameter of the circle: 10 mm). Incidentally, the widths of the transparent portions and the opaque portions in the circular areas of the negative film were 50 micrometers and 100 micrometers, respectively. On the negative film was placed a 20 micrometer-thick polypropyrene film.

The above-obtained photocurable resin composition containing a delustering agent was poured onto the polypropyrene film. On the photocurable resin composition was placed a 200 micrometer-thick polyethylene terephthalate film having on one surface a urethane type adhesive layer applied thereto in such a manner that the photocurable resin composition was contacted with the adhesive layer of the polyethylene terephthalate film. The thickness of the photocurable resin composition layer was adjusted to 150 micrometers with the use of a spacer.

The resulting laminate assembly was exposed for about 80 seconds from the side of the negative film to actinic rays from a 3 KW ultra-high pressure mercury lamp placed at a distance of 1 m from the surface of the laminate assembly, thereby causing the photocurable resin composition to be photocured in the circular striped pattern portions and their peripheral portions.

Thereafter, the negative film and polypropyrene film were removed. Over the surface of the resin composition layer was sprayed a weakly alkaline solution (a 1% aquenous solution of sodium borate) heated to 40°C. to wash away the non-exposed, uncured areas of the resin composition layer. The resulting product was rinsed with water, dried, postirradiated for 180 seconds by the same actinic rays as used above, and immersed in a 70°C. bath containing 0.5% by weight of a metallized dye (Lanyl Black BG, produced and sold by Sumitomo Chemical Company Ltd., Japan) to dye the photocured resin composition layer.

The light-shielding lines of the light-shielding screen portions of the photocured resin composition layer each had a width of 50 micrometers and a height of 150 micrometers, and were arranged at intervals of 100 micrometers.

A 400 micrometer-thick polycarbonate film having on one surface a double-side adherent tape adhered thereto was put on the photocured resin composition layer so that the adherent tape surface contacted the composition layer and then subjected to press bonding at 40°C. using a laminator. An image 7 as shown in FIG. 3 was printed on the surface of the second light transmissible substrate at its portions corresponding to the light-shielding screen portions by means of screen printing. The resulting product was cut to obtain a plurality of light-shielding screen devices (30×30 mm) of the present invention as shown in FIG. 3. The minimum distance between the edge of the intermediate layer (photocured resin composition layer) and the circumstance of the light-shielding screen portion located in the middle of the intermediate layer was 10 mm. Incidentally, in preparing the light-shielding screen devices by cutting, there was caused no peeling of the first and second-light transmissible substrates from the intermediate layer. The above-obtained light-shielding screen device was securely attached to a knob of a push button type switch system by means of an adhesive for use as an indicator means as depicted in FIG. 6. The indicator means were repeatedly pushed for switching (on or off) the instrument connected to the switch system. During the use of the light-shielding screen device as an indicator means of the push button type switch system, there was no peeling of the first and second light transmissible substrates from the intermediate layer.

COMPARATIVE EXAMPLE

Substantially the same procedures as in the above Example were repeated to form a phtocured resin composition layer on the first light transmissible substrate made of a polyethylene terephthalate film, except that a striped pattern negative film having 50 micrometer-wide transparent portions and 100 micrometer-wide opaque portions was used instead of the negative film used in the above Example.

Thus, there was obtained a photo-relief plate having entirely on the surface thereof relief lines (width, 50 micrometers; height, 150 micrometers; and intervals, 100 micrometers). In the same manner as in the above Example, a 400 micrometer-thick polycarbonate film was put on the photocured resin composition layer (relief lines) and subjected to press bonding at 40°C. using a laminator AL-70 manufactured and sold by Asahi Kasei Kogyo K.K., Japan. The thus obtained product was cut to obtain a plurality of light-shielding screen devices having the same size (30×30 mm) as those obtained in the above Example. In preparing the light-shielding screen devices by cutting, some portions of the relief lines were damaged, and at the peripheral portions of the devices there were caused peeling of the first and second light transmissible substrates from the intermediate layer (relief lines). Therefore, the obtained light-shielding screen devices could not be used as an indicator means of a push button type switch system.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A light-shielding screen device comprising:
(a) a first light transmissible substrate;
(b) a second light transmissible substrate; and
(c) an intermediate layer located between said first light transmissible substrate and said second light transmissible substrate,
said intermediate layer comprising at least one light-shielding screen portion and a light non-transmissible retaining portion,
said at least one light-shielding screen portion being located in the middle area of said intermediate layer and said light non-transmissible retaining portion located at least in a portion of the remaining area of said intermediate layer, said portion of the remaining area including the entire outermost peripheral area of said intermediate layer,
said light-shielding screen comprising a plurality of nontransparent light shielding lines,
said light non-transmissible retaining portion of the intermediate layer securely retaining on both its sides said first light transmissible substrate and said second light transmissible substrate, respectively.

2. A light-shielding screen device according to claim 1, wherein said light-shielding lines are arranged to form a polygonal network pattern structure.

3. A light-shielding screen device according to claim 2, wherein said polygonal network structure is a honeycomb pattern structure.

4. A light-shielding screen device according to claim 1, wherein said intermediate layer comprises a photocured form of a photocurable resin composition.

5. A light-shielding screen device according to claim 4, wherein said photocurable resin composition is a radical photopolymerizable composition comprising a compound having a polymerizable ethylenically unsaturated group and a radical photopolymerization initiator.

6. A light-shielding screen device according to claim 4, wherein said photocurable resin composition is an addition photoreactable composition comprising a polyene compound having a plurality of double bonds, a polythiol compound having a plurality of thiol groups and a photosensitizer.

7. A light-shielding screen device according to claim 3, wherein said photocurable resin composition is a cation photopolymerizable composition comprising a cation polymerizable compound having an epoxy group and a cation photopolymerization initiator.

8. A light-shielding screen device according to claim 3, wherein said photocurable resin composition is a photocrosslinkable composition comprising a polymer having a functional group capable of being photodimerized.

9. A light-shielding screen device according to claim 1, wherein said light non-transmissible retaining portion is located in an entire portion of the remaining area of said intermediate layer.

10. A light-shielding screen device according to claim 1, wherein said light-shielding screen portion is in the form of a predetermined image.

11. A light-shielding screen device according to claim 1, wherein each separate line of said plurality of light-shielding lines is placed at a spaced interval from another line.

12. A light-shielding screen device according to claim 11, wherein said light-shielding lines are arranged at 20 to 1,000 micrometers apart from each other and each have a width of 10 to 500 micrometers and wherein the ratio of said width to said interval is about 1:1 to about 1:20.

13. A light-shielding screen device according to claim 11, wherein said plurality of light-shielding lines are parallel to the horizontal direction as viewed against the surface of the first light transmissible substrate.

14. A light-shielding screen device according to claim 11, wherein said plurality of light-shielding lines are perpendicular to the horizontal direction as viewed against the surface of the first light transmissible substrate.

15. A light-shielding screen device according to claim 11, wherein said plurality of light-shielding lines are aslant with a slanting angle of 30° to 60° relative to the horizontal direction as viewed against said surface of the first light transmissible substrate.

16. A light-shielding device according to claim 11, wherein said light-shielding lines intersect a plurality of crossing light-shielding lines each separately placed at a spaced interval from another line, to thereby form a screen pattern structure.

17. A light-shielding screen device according to claim 16, wherein said crossing light-shielding lines orthogonally intersect said light-shielding lines as viewed against the surface of said first light transmissible substrate.

18. A light-shielding screen device according to claim 16, wherein said light-shielding lines are left aslant with a slanting angle of 30° to 60° relative to the horizontal direction as viewed against the surface of the first light transmissible substrate and said crossing light-shielding lines are right aslant with a slanting angle of 30° to 60° relative to the horizontal direction as viewed against the surface of the first light transmissible substrate.

* * * * *

UNITED STATES PATENT AND TRADEMARK OFFICE

CERTIFICATE OF CORRECTION

PATENT NO. : 4,688,156

DATED : Aug. 18, 1987

INVENTOR(S) : Suzuki et al

It is certified that error appears in the above-identified patent and that said Letters Patent is hereby corrected as shown below:

In the category "[73] Assignee:" change "Kabushiki Kaisha Tokai, Aichi, Japan" to --Kabushiki Kaisha Tokai Rika Denki Seisakusho, Aichi, Japan and Asahi Kasei Kogyo Kabushiki Kaisha, Osaka, Japan--.

Signed and Sealed this

Thirteenth Day of September, 1988

*Attest:*

*Attesting Officer*

DONALD J. QUIGG

*Commissioner of Patents and Trademarks*